US006637616B2

(12) United States Patent
Couto

(10) Patent No.: US 6,637,616 B2
(45) Date of Patent: Oct. 28, 2003

(54) NOZZLE FOR BEVERAGE CAN

(76) Inventor: Gilberto de Castro Couto, Rua João Pontoni, n°Apto 1902 C.Rei, Curitiba, PR (BR), CEP80050-490

( * ) Notice: Subject to any disclaimer, the term of this patent is extended or adjusted under 35 U.S.C. 154(b) by 207 days.

(21) Appl. No.: 09/914,806

(22) PCT Filed: Apr. 16, 2001

(86) PCT No.: PCT/BR01/00049

§ 371 (c)(1),
(2), (4) Date: Aug. 30, 2001

(87) PCT Pub. No.: WO02/46052

PCT Pub. Date: Jun. 13, 2002

(65) Prior Publication Data

US 2003/0146226 A1 Aug. 7, 2003

(30) Foreign Application Priority Data

Dec. 5, 2000 (BR) ..... 80002964 U

(51) Int. Cl.[7] ..... A47G 19/22
(52) U.S. Cl. ..... 220/717; 220/718
(58) Field of Search ..... 220/717, 718, 220/713, 715, 711

(56) References Cited

U.S. PATENT DOCUMENTS 4,715,510 A * 12/1987 van der Meulen et al. . 220/718
5,240,132 A * 8/1993 Tucker ..... 220/212
5,467,888 A * 11/1995 Brandstrom et al. ..... 220/319
D368,032 S 3/1996 Couto ..... D9/435
5,823,384 A * 10/1998 Sartori de Zamparolo .. 220/717
5,947,324 A * 9/1999 Palinchak ..... 220/713
5,984,127 A * 11/1999 Fenton ..... 220/254.1

FOREIGN PATENT DOCUMENTS

BR MU 7202223-0 5/1995

* cited by examiner

*Primary Examiner*—Joseph M. Moy
(74) *Attorney, Agent, or Firm*—Kinney & Lange, P.A.

(57) ABSTRACT

A NOZZLE ADAPTED TO BE COUPLED TO A CAN CONTAINING A BEVERAGE, characterized by presenting arrangements of improvement to a nozzle for the ingestion of canned liquids in general, moldable to cans containing liquids to be ingested by means of snap-on (1) under pressure. There exists in panel (2) an aperture in a new half-moon shape (3), and the creation of two small apertures (6) to allow air into the can. There is also a new downgrading and hollowed area to direct the liquid back into aperture (3), and a new snap-on by pressure chamfered device (1.1) in channel (1) for coupling the nozzle to the can. There is a labial spout (7) provided in its internal lower base with two coupling devices, device (7.3) and device (7.4). The spout is designed as two semiarches (7.1 and 7.2), with a shape coinciding precisely with the profile of the top end of the can, destined to couple the nozzle to the can in an inverted position.

4 Claims, 5 Drawing Sheets

NOZZLE FOR BEVERAGE CAN

This patent of an utility model refers to ARRANGEMENTS INTRODUCED IN A NOZZLE ADAPTED TO BE COUPLED TO A CAN CONTAINING A BEVERAGE, characterized for presenting improvement arrangements to a nozzle for the ingestion of liquids in general, coupled to the can through snap-on pressure, making the part more efficient, and providing a practical, functional, and above all safe, means for people to use canned liquids, for immediate consumption.

It is generally known, through utility model patent MU7202223-0, the existence of a nozzle of the same nature, which, however, presents fault regarding its bottom circumference, which defines the bottom panel, adaptable and moldable to the top external ring of the can, since this panel does not correctly direct the liquid to a better return thereof to within the can, through the aperture of the nozzle. There is also a deficiency regarding the regularity of passage the liquid through the aperture of the nozzle that permits its flowing into the mouth of the consumer, and in the attachment of the nozzle to the can, as well as in the body of the tubular portion of the nozzle, that does not fit properly to the coupling of the nozzle, in an inverted position, at the top of the can. The improvements introduced to MU7202223-0 correspond to the correction of the bottom panel, redesigning the portion of the panel in contact with the top portion of the can, including the redesigning of the snap-on device of the part to the can, and the redesigning of the profile of the nozzle for the correct coupling thereof, in the inverted position, to the top portion of the can.

The present patent of utility model presents, through the modifications introduced as improvements to the nozzle characterized in MU7202223-0, of the same titleship of the present patent, providing the final product with new technical, formal and functional aspects, much more practical and efficient.

For a better understanding of the present patent of utility model, denominated Arrangements Introduced in a Nozzle Adapted to be Coupled to a Can Containing a Beverage, we give below a detailed description of this nozzle, referring to the appended drawings, as follows.

Figure 1:
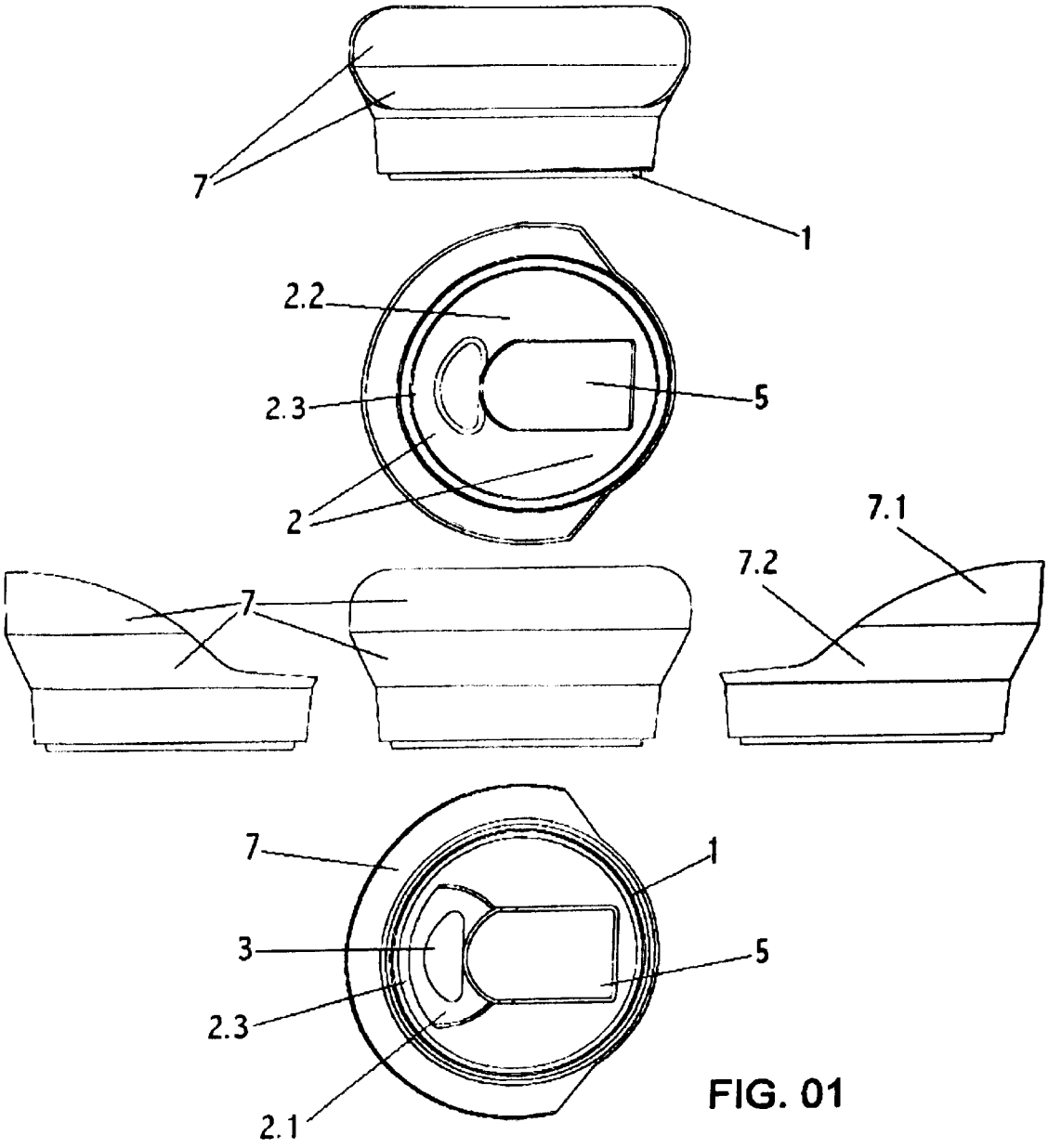
FIG. 01 shows frontal, lateral, upper, lower and backside views of the patent of utility model Arrangements Introduced in a Nozzle Adapted to be Coupled to a Can Containing a Beverage.
Figure 2:
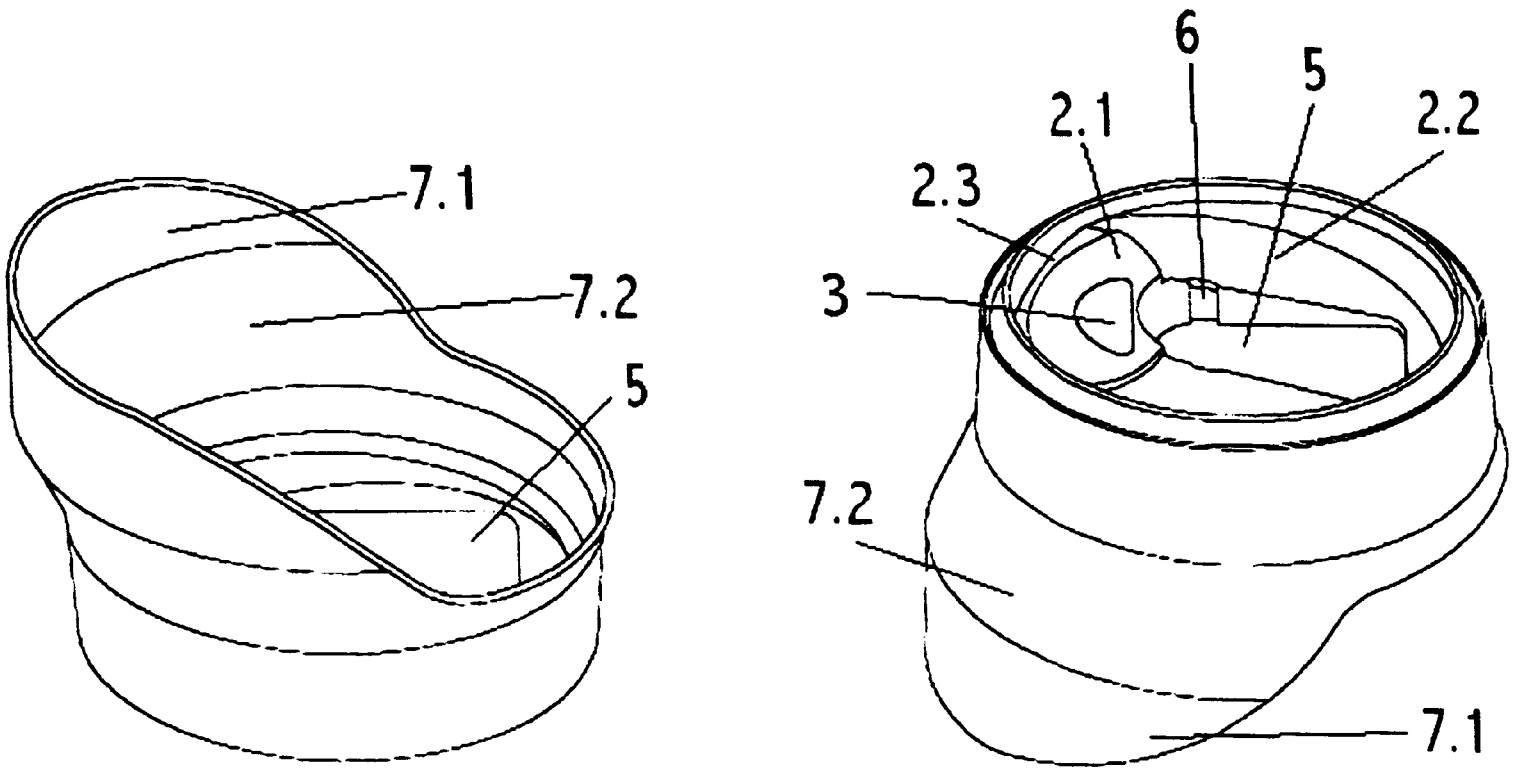
FIG. 02 shows, in perspective, the upper and lower views of the patent of utility model Arrangements Introduced in a Nozzle Adapted to be Coupled to a Can Containing a Beverage.
Figure 3:
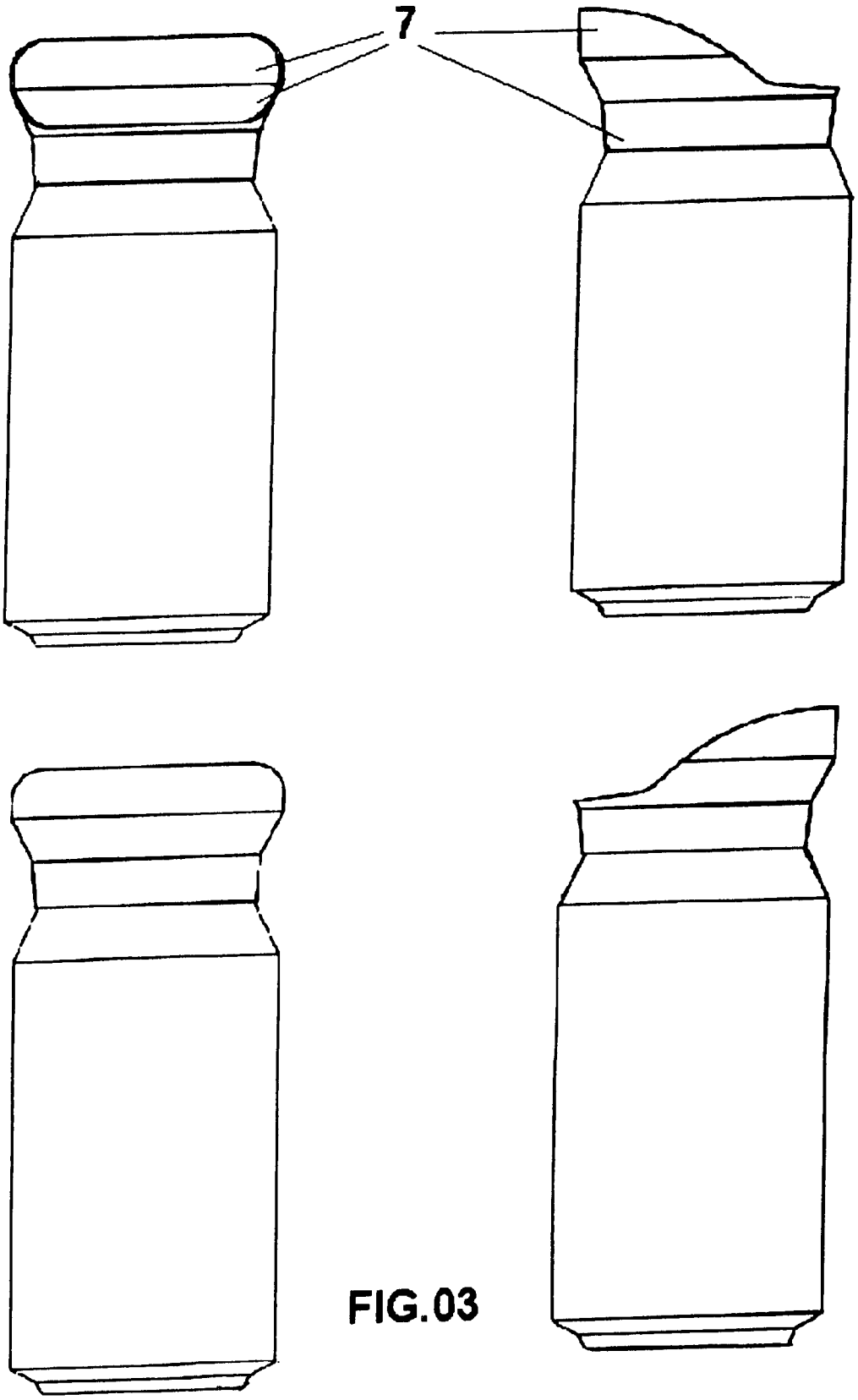
FIG. 03 shows the patent of utility model Arrangements Introduced in a Nozzle Adapted to be Coupled to a Can Containing a Beverage as frontal, backside and lateral views showing the positioning of the nozzle in relation to the can when being used by the consumer.
Figure 4:
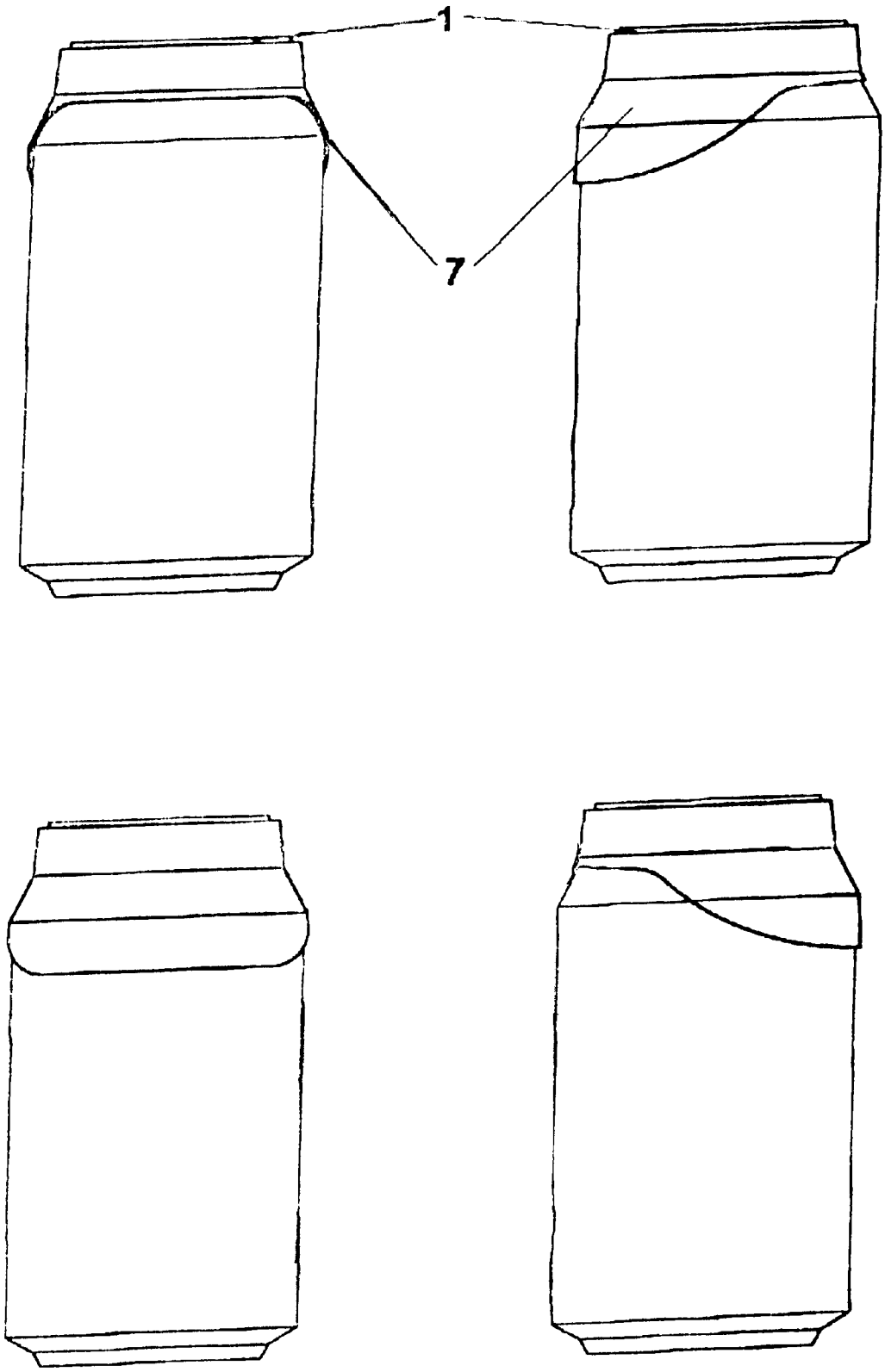
FIG. 04 shows the patent of utility model Arrangements Introduced in a Nozzle Adapted to be Coupled to a Can Containing a Beverage under frontal, backside and lateral views, showing the positioning of the inverted nozzle, when in a sales stand or warehouse.
Figure 5:
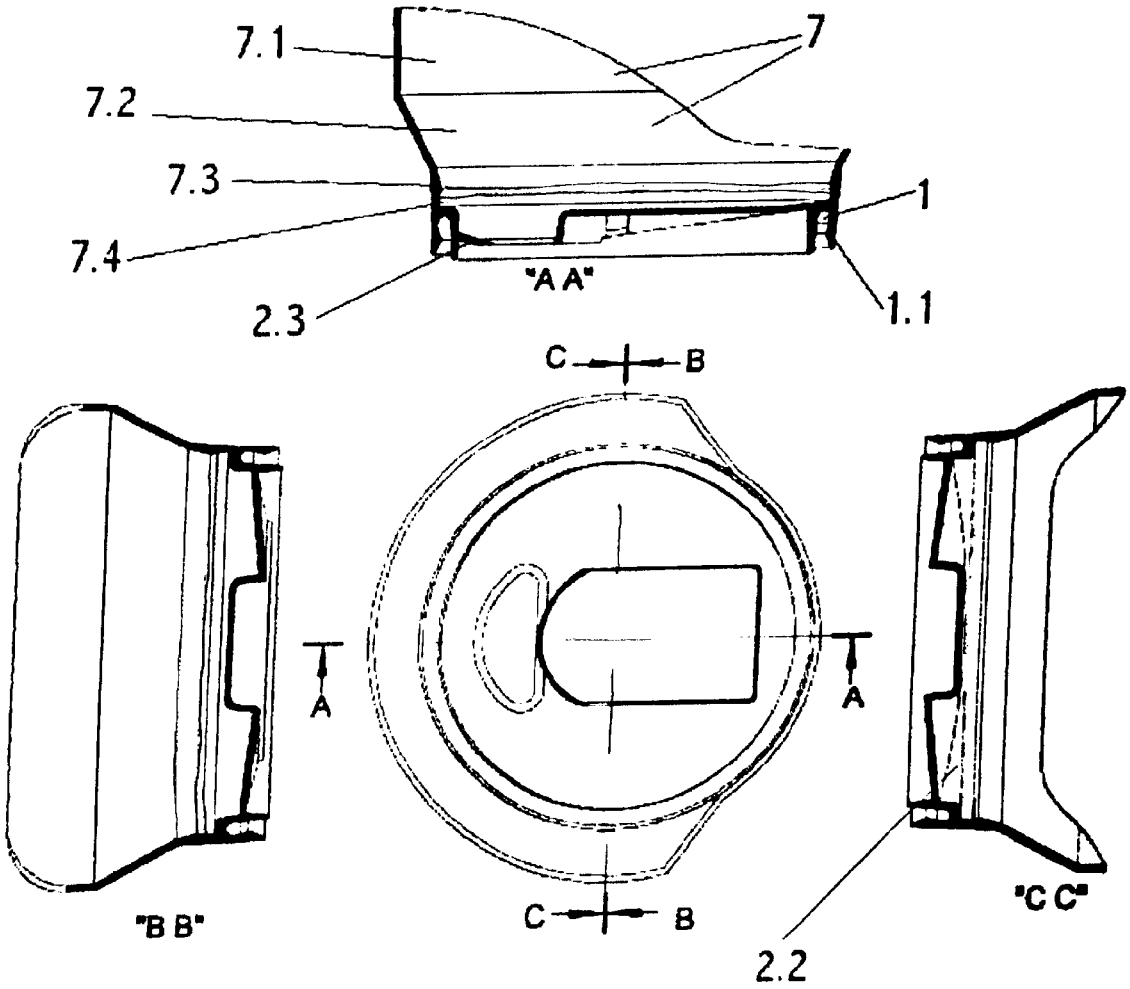
FIG. 05 shows section views of the patent of utility model denominated Arrangements Introduced in a Nozzle Adapted to be Coupled to a Can Containing a Beverage.

According to FIGS. 01 to 05, this patent of utility model denominated Arrangements Introduced in a Nozzle Adapted to be Coupled to a Can Containing a Beverage is of the conventional type, made of plastic, and presents its design determined by a single part of tubular section, having in its lower circumference a channel (1) as shown in FIGS. 01 and 05, moldable and attachable under pressure to the top external ring of a can containing a liquid to be ingested. This channel (1) contains a snap-on chamfered device (1.1) that eliminates the resistance offered by the semicircular flange formerly used in MU7202223-0, of the same titleship hereof. This new design in the snap-on device (1.1) directs the entry of the can ring into the channel (1), since the new format allows for the chamfer (1.1) acting as a guide to the entry of the ring of the can into the channel (1), simultaneously acting as lock to prevent the ring from leaving the channel unless a force opposite to the snap-on is applied, thus providing a better coupling of the part to the can.

The tubular part is provided, at its lower end, with a traverse bottom panel (2) (FIG. 01) that in MU7202223-0, of the same titleship hereof, was totally adjacent to the disk of the top of the can, According to FIG. 01, the improvement of this present patent in the bottom panel (2) is its redesigning and new format, becoming then the area (2.1) (FIG. 01) of the panel (2) (FIG. 01) with the objective of only area (2.1) (FIG. 01) being sufficient for blocking the liquid between the nozzle and the top of the can. According to FIGS. 02 and 05, the area (2.2) is now downgraded, i.e. in declivity, and at the same time hollowed, from the end of the area (5), by the inner wall of the channel (1), beginning there in the same plane of area (5), till the limits of the area (2.1) where the downgrading stops, remaining in the same plane of the area (2.1). Between area (2.1) and channel (1), there is an area 2.3) designed so as to define a downgrading in the direction channel (1)/area (2.3). These improvements facilitate, during the use of the nozzle by the consumer, the guiding and return of the liquid spread on the bottom panel (2) from the part to the aperture (3) (FIG. 01), and the consequent return of the liquid to within the can.

Aperture (3) was redesigned and redimensioned to ensure an adequate and stable flow of the liquid coming out of the can, thus providing an ideal performance for the ingestion of the liquid contained in the can, and at the same time ensuring the important condition of the liquid flowing directly from inside the can to the mouth of the user, in a comfortable, hygienic and safe manner. There is an area (5) defined by the prominent rectangle, the side of which adjacent to the aperture (3) is semicircular, destined to house the tab that opens the can. The above mentioned rectangle (5) (FIGS. 01 and 02) is provided with lateral rectangular sections defining two small apertures (6) (FIG. 02) which allow the entering of air into the can, maintaining the regularity of the flow of the liquid contained in the can when being used by the consumer.

The upper end of the tubular part is formed by a labial spout (7) designed to present a higher portion that extends around only a portion of the tubular part, which is characterized as presenting two semiarches (7.1 and 7.2) with different diameters, overlapping so as to define a bowl from where the liquid flows when coming out of the can to be ingested by the consumer. According to FIG. 04, with the purpose of adjusting the nozzle device to large scale consumption, it was designed so that the nozzle, previously packaged, may be coupled, in an inverted position, (FIG. 04), directly to the upper portion of the can, remaining attached to its top end, therefore with the labial spout (7) turned towards the lower end of the can. The design of the labial spout (7) (FIG. 01) through its two semiarches (7.1 and 7.2) (FIG. 01) coincides with the external profile of the upper end of the can, so as to allow the perfect coupling of nozzle and can. Said coupling is made through two snap-on devices located in the internal lower base of the labial spout (7). The device (7.3) is defined by a protuberance that fixes the nozzle in the inverted position. Device (7.4) is defined by an area destined to house the upper ring of the can. These improvements ensure that the product subject matter of this patent may offer every condition of hygiene of the device, its practicality in the use for consumption, its stacking coupled to the cans when warehoused as canned beverages, according to the current standards of warehousing. Nevertheless, the nozzle may be unitarily packed, to be sold apart from the cans, without invalidating all its other characteristics. The definition of semiarches (7.1 and 7.2) as well as area (5) may be destined to promotional finalities, even if any other portion of the part may be used with the same objective.

This nozzle is directed to the market of foodstuff packaging, i.e. canned beverages for immediate human consumption.

What is claimed is:

1. A nozzle device for coupling to a beverage can having a top with a lever tab that when pulled forms a drink opening in the top, and a top ring extending upwardly from a sidewall of the can, the device comprising:

a main body ring portion having a first annular channel configured to be attachable to the top ring of the can in a snap-fit fashion;

a spout member extending from the main body ring portion for flow of beverage from the can; and a cover portion extending inwardly from the main body ring portion and having a first opening configured so that the tab of the can may be pulled and a second opening for fluid flow from the drink opening into the spout.

2. The device of claim 1 and further comprising a second annular channel disposed within the main body ring portion on a side opposite from the first annular channel for engaging the top ring of the can and wherein the spout is configured to conform to the exterior shape of the sidewall of the can.

3. A beverage can device comprising:

a beverage can having a top with a lever tab that when pulled forms a drink opening in the top, and a top ring extending upwardly from a sidewall of the can and above the top;

a main body ring portion having a first annular channel attached to the top ring of the can in a snap-fit detachable fashion through the first annular channel;

a spout member extending from the main body ring portion for flow of beverage from the can; and a cover portion extending inwardly from the main body ring portion and having a first opening configured so that the tab of the can may be pulled and a second opening for fluid flow from the drink opening into the spout.

4. The device of claim 3 and further comprising a second annular channel disposed within the main body ring portion on a side opposite from the first annular channel for engaging the top ring of the can after the main body ring portion is detached from the top ring and wherein the spout is configured to conform to the exterior shape of the sidewall of the can when the second channel is engaged with the sidewall of the can.

* * * * *